United States Patent [19]

Carlin

[11] 3,966,576

[45] June 29, 1976

[54] ELECTROPHORETIC DEPOSITION OF ASBESTOS DIAPHRAGMS

[75] Inventor: William W. Carlin, Portland, Tex.

[73] Assignee: PPG Industries, Inc., Pittsburgh, Pa.

[22] Filed: July 15, 1974

[21] Appl. No.: 488,871

[52] U.S. Cl. ..... 204/181; 204/266; 204/283

[51] Int. Cl.[2] ..... C25B 11/00; C25B 13/06; C25D 13/02

[58] Field of Search ..... 204/181, 266, 283

[56] References Cited

UNITED STATES PATENTS 3,449,227 6/1969 Heron et al. ..... 204/181

3,449,230 6/1969 Heron et al. ..... 204/181

*Primary Examiner*—Howard S. Williams

*Attorney, Agent, or Firm*—Richard M. Goldman

[57] ABSTRACT

Disclosed is a method of preparing a fibrous, alkali metal chloride brine permeable asbestos diaphragm. The diaphragm is prepared by placing a first electrode in a liquid composition containing asbestos fibers and a surfactant. The liquid composition is maintained basic during the process and an electrical potential is maintained between the electrode on which the asbestos is to be deposited and a second electrode.

16 Claims, No Drawings

ELECTROPHORETIC DEPOSITION OF ASBESTOS DIAPHRAGMS

BACKGROUND OF THE INVENTION

In the electrolysis of alkali metal chlorides in diaphragm electrolytic cells, the alkali metal chloride brine is typically fed to the anolyte chamber of the cell. The anolyte liquor is an acidified alkali metal chloride solution typically having a pH of from about 2.5 to about 4.5 and the catholyte liquor solution is typically a strongly basic alkali metal hydroxide-alkali metal chloride solution. For example, in the case of sodium chloride electrolysis, the anolyte liquor is an acidified sodium chloride solution containing from about 125 to about 250 grams per liter of sodium chloride at a pH of from about 2.5 to about 4.5, and the catholyte liquor solution is typically a basic solution containing from about 110 grams per liter to about 145 grams per liter of sodium hydroxide and from about 180 grams per liter to about 215 grams per liter of sodium chloride.

The anolyte chamber of the cell is separated from the catholyte chamber of the cell by an electrolyte permeable asbestos diaphragm.

The diaphragms of the prior art have generally been prepared by depositing chrysotile asbestos on an electrolyte permeable, metal cathode by inserting the cathode assembly in a liquid composition of chrysotile asbestos and imposing a reduced pressure within the cathode assembly whereby to draw liquid composition through the cathode assembly depositing fibrous asbestos on the cathode. The diaphragms obtained in this way, while generally satisfactory, are characterized by a wide range of pore diameters within a given diaphragm. Additionally, the asbestos diaphragms of the prior art are characterized by non-uniformity of thickness, fiber orientation and the like.

SUMMARY

It has now been found that a thin, uniform asbestos diaphragm of fairly uniform porosity and pore diameter may be provided by the electrophoretic deposition of asbestos fibers onto the electrode. Thus, a fibrous, alkali metal chloride brine permeable asbestos diaphragm is deposited on a first electrode by placing the first electrode in a liquid composition containing from about 0.1 to about 1.0 weight percent of asbestos. The liquid solution further includes from about 0.01 to about 0.10 weight percent of a suitable surfactant. The liquid composition is maintained basic, and an electrical potential is established between the first electrode and the second electrode whereby to provide an electrophoretic current density sufficient to deposit the asbestos fibers on the first electrode.

DETAILED DESCRIPTION

According to the method of this invention fibrous asbestos, including individual fibers and fibriles, is deposited on a first electrode providing an alkali metal chloride brine permeable diaphragm. The first electrode, that is, the anode of the electrophoretic deposition cell, is the cathode of the chlorine cell. Typically, the first electrode is prepared from an electroconductive metal, resistant to chlorine cell catholyte liquor under diaphragm cell operating conditions. That is, it is prepared from a metal that is resistant to basic media such as 50 percent or even 60 weight percent solutions of sodium hydroxide. Most commonly it is prepared from iron, steel, stainless steel, or copper. Additionally, the metal is characterized by a low hydrogen overvoltage, that is, a hydrogen overvoltage in alkaline solution of less than about 0.70 volts. The first electrode has an electrolyte permeable structure. That is, it has individual open regions and individual metallic regions. The first electrode may be fabricated of metal strand, metal wire, metal mesh or perforate plate.

The first electrode is inserted in a suitable electroconductive liquid composition containing dispersed asbestos and a surfactant. Preferably, the asbestos is chrysotile asbestos. The chrysotile asbestos content of the bath should be sufficiently low to avoid tangling of the asbestos fibers and the formation of asbestos fiber agglomerates at the fiber lengths herein contemplated with the surfactants herein contemplated, but high enough to provide suitable electrophoretic deposition of the asbestos. Typically, the content of chrysotile asbestos in the electrophoretic deposition bath is from about one-tenth of one percent to about one percent and preferably from about 0.2 weight percent to about 0.4 weight percent.

The individual chrysotile asbestos fibers generally have a length short enough to remain in suspension at the asbestos concentrations contemplated herein with the surfactants contemplated herein but large enough to provide the desired degree of porosity. Typically, the asbestos fibers are Quebec Asbestos Producers Association standard screen size grade 5K or 5D, grade 4T being too large and grade 6 being too small. Generally, about 60 to about 75 percent of the 5D and 5K fibers, fibriles and fiber bundles are in the size range of between 4 and 10 mesh, not more than 25 percent are in the size range of less than 10 mesh, and not more than 5 percent are in the size range of greater than 4 mesh. Grades 5K and 5D asbestos will be referred to herein as having a nominal fiber length of 4 to 10 mesh Q.A.P.A. it being noted that by such specification of fiber size it is meant that from about 60 to about 75 percent of the fibers, fibriles and tube bundles are in the size range specified.

The electrophoretic deposition bath further includes a suitable surfactant. The surfactant performs two functions. First, the surfactant molecule carries charge-containing groups whereby to transport the asbestos fibers and fibrile through the electrolyte to the anode of the electrodeposition cell. Second, the surfactant reduces the surface tension of the electrodeposition bath. As a general rule, the surfactant is an anionic surfactant when the first electrode, i.e., the electrode upon which the asbestos is to be deposited, is anodic with respect to the second electrode. However, the surfactant may also be a cationic surfactant if the first electrode, i.e., the electrode on which the asbestos is to be deposited, is the cathode of the electrodeposition cell. Alternatively, some or all of the surfactant may be a non-ionic surfactant.

The anionic surfactants include those polymers and polymeric materials having an equivalent weight of from about 500 to about 1200 and having suitable acid groups. Suitable acid groups include carboxylic acid groups as found in the acrylic acids, steric acid, oleic acid, citronic achid anhydride, and the like. Alternatively, the acid group may be the sulfonic acid group, such as a fluorocarbon sulfonic acid, Monsanto "Sulfram 85," aromatic benzene sulfonate, DuPont "Zonyl FSK," DuPont NAFION, 3M Company's FE-128, or ICI "Monofluor 31." Alternatively, the anionic group may be a phosphate group as in GAF "GAFAC RA-600" or carboxylic acid-amide groups as in GAF "IGEPON."

Fluorocarbon surfactants are preferred because there is some entrainment of the surfactant molecules with the electrodeposited asbestos. Entrained alkyls may decompose under electrolytic cell operation to form carbon dioxide and gummy residues which interfere with the operation of the cell. Fluorocarbon surfactants generally do not decompose under chlorine cell operating conditions, and are therefore preferred for this use.

The concentration of surfactant should be low enough to allow the pH to be maintained above about 5.5 and preferably between about 9 and about 10 as will be described more fully hereinafter. As a general rule, the concentration of surfactant is from about 0.01 weight percent of the electrodeposition bath to about 0.1 weight percent of the electrodeposition bath and preferably from about 0.04 weight percent to about 0.05 weight percent of the electrodeposition bath. The surfactants may be mixed, for example, an anionic surfactant may be mixed with a weakly ionic or non-ionic surfactant. Thus, according to one exemplification of this invention the electrophoretic deposition bath includes about 0.003 weight percent of Monsanto "Sulfram 85" aromatic benzene sulfonate and about 0.04 weight percent of polyacrylic acid. As a general rule, the use of a non-ionic or weakly ionic surfactant with an anionic surfactant may be necessary where it is necessary to buffer the electrophoretic deposition bath to maintain the pH of the bath within the desired limits.

The pH of the bath should be above the isoelectric point of asbestos which is a pH of about 5.5 but below a pH of about 11.3. Preferably, the pH of the electrodeposition bath is from about 9 to about 10. It is necessary to maintain the solution basic because of the gradual release of calcium ion by the asbestos. As a general rule, the pH is maintained by the addition of weak acids or anionic surfactants in the electrodeposition bath.

The electrodeposition potential and current are functions of the inter-electrode gap and of the resistance of the cell and the electrolyte. The electrodeposition potential should be sufficient to deposit asbestos on the anode of the cell. As a general rule this is a potential of from about 150 to about 200 volts, although electrodeposition potentials in excess of 200 volts, for example 250 or even 300 volts, may be necessary.

The electrophoretic deposition current density should be low enough to avoid bubble evolution at the anode, which may result in non-uniformity, but high enough to provide a satisfactory rate of electrodeposition. As a general rule, the electrodeposition current density should be above 2 amperes per square foot and preferably above 4 amperes per square foot but generally below about 10 amperes per square foot and preferably below about 7 amperes per square foot. The preferred range of current density is from about 4 to about 7 amperes per square foot.

Additionally, after electrodeposition the diaphragms may be subjected to further treatment, such as dehydration, baking, deposition of resins and surfactants and the like.

While the invention has been described with reference to an electrolyte permeable diaphragm, the method of this invention is also useful in the preparation of permionic membranes. In preparing permionic membranes the asbestos is deposited as described hereinabove, and thereafter it is treated with suitable ion exchange resins, surfactants, prepolymers, and the like to render it permionic.

The following examples are illustrative.

EXAMPLES I THROUGH VIII

A series of tests were run to determine the effects of current density and deposition time on the electrophoretic deposition of asbestos from a liquid composition of asbestos fibers and a surfactant in water. In each test, identical solutions of 0.27 weight percent Johns-Manville 5D-12 chrysotile asbestos, 0.04 weight percent acrylic acid and 0.004 weight percent Monsanto "Sulfram 85" aromatic benzene sulfonate were prepared in a 12-inch wide by 12-inch thick by 9-inch deep polyethylene tank. The liquid composition was continuously circulated with a ⅛ horsepower open impeller centrifugal pump. In each test, a 3 inch by 3 inch perforated steel plate was utilized as the electrodeposition anode and a galvanized steel plate was utilized as the cathode. The D.C. power supply was a Lambda 64 M high voltage source. The temperature of the electrodeposition bath was not controlled but ranged from 25°C at the beginning of the experiment to about 40°C after approximately 4 hours of electrodeposition. The results are shown in Table I, "Electrophoretic Deposition of Asbestos Diaphragms." The voltage is reported in terms of volts, the current is reported in terms of milliamperes, current density is in terms of amperes per square foot, and the electrodeposition time is in hours and the appearance is in terms of the appearance when visually examined without aid and after removal from the electrophoretic deposition anode, blotting, and drying in air at room temperature for 72 hours. Example I to IV were made with a 9-square inch electrodeposition anode, and runs V to VIII were made with a 16-square inch electrodeposition anode.

Electrophoretic Deposition of Asbestos Diaphragm
Table I

| Example | Current (Milliamperes) | Voltage (Volts) | Current Density (Amperes/sq. ft.) | Time (Hours) | Appearance |
|---|---|---|---|---|---|
| I | 490 | 175 | 7.9 | 5.0 | Heavy deposit |
| II | 480 | 175 | 7.8 | 0.25 | Light deposit (0.06 lbs/ft²) |
| III | 480 | 175 | 7.8 | 0.50 | Medium deposit (0.14 lbs/ft²) |
| IV | 480 | 175 | 7.8 | 0.75 | Heavy deposit (0.25 lbs/ft²) |
| V | 460 | 175 | 4.15 | 0.25 | Light deposit (0.028 lbs/ft²) |
| VI | 400 | 180 | 3.6 | 0.50 | Light deposit (0.067 lbs/ft²) |
| VII | 370 | 190 | 3.35 | 0.75 | Medium deposit |

-continued

Electrophoretic Deposition of Asbestos Diaphragm
Table I

| Example | Current (Milliamperes) | Voltage (Volts) | Current Density (Amperes/sq. ft.) | Time (Hours) | Appearance |
|---|---|---|---|---|---|
| VIII | 410 | 190 | 3.70 | 1.00 | (0.10 lbs/ft²) Heavy deposit (0.27 lbs/ft²) |

The above data shows the dependence on current density in the range of from 3.35 to 7.9 amperes per square foot and the effect of deposition time. Runs I to IV and V to VIII respectively show that deposition is approximately linear with deposition time. Runs II and V, III and VI, and IV and VII respectively show the effect of current density.

While the invention has been described with reference to certain exemplifications and embodiments, the scope of the invention is not to be so limited as alterations and modifications may be made which are within the full intended scope of my invention.

I claim:

1. In a method of assemblying a chlor-alkali diaphragm cell wherein an electrolyte permeable first electrode having an aqueous sodium chloride brine permeable asbestos diaphragm thereon and a second electrode are inserted in a cell body, the improvement wherein the aqueous sodium chloride brine permeable diaphragm is deposited by the method comprising:

A. placing the first electrode in an aqueous liquid composition comprising (1) chrysotile asbestos at a concentration below 1.0 weight percent to avoid formation of asbestos fiber agglomerates and high enough to allow electrophoretic deposition and having a nominal fiber length short enough to remain in suspension and long enough to form a porous deposited diaphragm, and (2) sufficient surfactant to transport the asbestos and reduce the surface tension of the liquid composition while maintaining the pH thereof above the isoelectric point of asbestos;

B. maintaining said liquid composition basic; and

C. maintaining an electrical potential above about 150 volts between the first electrode and a second electrode in said liquid composition to provide an electrophoretic current density.

2. The method of claim 1 wherein said first electrode is maintained anodic with respect to said second electrode during the deposition of asbestos.

3. The method of claim 2 wherein said first electrode is maintained at an anodic potential of at least 150 volts with respect to said second electrode.

4. The method of claim 2 wherein said liquid composition includes an anionic surfactant and a non-ionic surfactant whereby to maintain said liquid composition basic.

5. The method of claim 2 wherein said surfactant is an anionic surfactant.

6. The method of claim 5 wherein said anionic surfactant is an anionic fluorocarbon-sulfonic acid resin.

7. The method of claim 5 wherein said anionic surfactant is chosen from the group consisting of carboxylic acids, carboxylic acid amides, and phosphates.

8. The method of claim 1 wherein said first electrode is maintained cathodic with respect to said second electrode during the deposition of asbestos.

9. The method of claim 8 wherein said first electrode is maintained at a cathodic potential of at least 150 volts with respect to said second electrode.

10. The method of claim 8 wherein said surfactant is a cationic surfactant.

11. The method of claim 1 comprising maintaining the pH of the liquid composition below about 11.3.

12. The method of claim 11 comprising maintaining the pH of the liquid composition between 9 and 10.

13. The method of claim 1 wherein the asbestos concentration is from about 0.1 to about 1.0 weight percent.

14. The method of claim 1 wherein the asbestos has a nominal fiber length of from 4 mesh, Q.A.P.A., to 10 mesh, Q.A.P.A.

15. The method of claim 1 wherein the surfactant concentration is from about 0.01 to about 0.10 weight percent.

16. In a method of assemblying a chlor-alkali diaphragm cell wherein an electrolyte permeable first electrode having an aqueous sodium chloride brine permeable asbestos diaphragm thereon and a second electrode are inserted in a cell body, the improvement wherein the aqueous sodium chloride brine permeable diaphragm is deposited by the method comprising:

A. placing the first electrode in an aqueous liquid composition comprising (1) chrysotile asbestos at a concentration of from about 0.1 weight percent to about 1.0 weight percent thereby avoiding formation of asbestos fiber agglomerates while allowing electrophoretic deposition and having a nominal fiber length of from about 4 mesh Q.A.P.A., to about 10 mesh, Q.A.P.A., whereby to remain in suspension without settling and to form a porous deposited diaphragm, and (2) sufficient surfactant to transport the asbestos and reduce the surface tension of the liquid composition while maintaining the pH above the isoelectric point of asbestos;

B. maintaining said liquid composition basic; and

C. maintaining an electrical potential above about 150 volts between the first electrode and a second electrode in said liquid composition to provide an electrophoretic current density.

* * * * *